US010214972B2

(12) United States Patent
Butt et al.

(10) Patent No.: US 10,214,972 B2
(45) Date of Patent: Feb. 26, 2019

(54) VIBRATION ASSISTED ROTARY DRILLING (VARD) TOOL

(71) Applicants: Stephen Butt, St. John's (CA); Brock Gillis, Calgary (CA); Pushpinder Singh Rana, Pathankot Punjab (IN)

(72) Inventors: Stephen Butt, St. John's (CA); Brock Gillis, Calgary (CA); Pushpinder Singh Rana, Pathankot Punjab (IN)

(73) Assignee: Memorial University of Newfoundland, St. John's (CA)

( * ) Notice: Subject to any disclaimer, the term of this patent is extended or adjusted under 35 U.S.C. 154(b) by 110 days.

(21) Appl. No.: 15/314,265

(22) PCT Filed: May 29, 2015

(86) PCT No.: PCT/CA2015/000345

§ 371 (c)(1),
(2) Date: Nov. 28, 2016

(87) PCT Pub. No.: WO2015/179953

PCT Pub. Date: Dec. 3, 2015

(65) Prior Publication Data

US 2017/0096862 A1 Apr. 6, 2017

Related U.S. Application Data

(60) Provisional application No. 62/005,533, filed on May 30, 2014.

(51) Int. Cl.
*E21B 17/07* (2006.01)
*E21B 7/24* (2006.01)
(Continued)

(52) U.S. Cl.
CPC ..... *E21B 17/076* (2013.01); *E21B 3/00* (2013.01); *E21B 7/24* (2013.01); *E21B 12/00* (2013.01)

(58) Field of Classification Search
CPC ..... E21B 17/07; E21B 17/076; E21B 7/24
See application file for complete search history.

(56) References Cited

U.S. PATENT DOCUMENTS 4,276,948 A 7/1981 Hebel
4,502,552 A 3/1985 Martini
(Continued)

FOREIGN PATENT DOCUMENTS

GB 2486287 6/2012

OTHER PUBLICATIONS

Canadian Intellectual Property Office, International Search Report (Form PCT/ISA/210, 2 pgs.) and Written Opinion of the International Searching Authority (Form PCT/ISA/237, 4 pgs.), Jul. 14, 2015.

(Continued)

*Primary Examiner* — Giovanna C. Wright
(74) *Attorney, Agent, or Firm* — Wood Herron & Evans LLP

(57) ABSTRACT

Vibration assisted rotary drilling (VARD) tools that provide axial compliance and low amplitude axial displacements at the drill bit while transmitting the full rotary speed and torque of the drill string to increase drilling penetration rate. The VARD tools consist essentially of: i) an axially compliant section which transfers axial load across the tool; ii) a mechanism for opposing ends of the tool to displace axially relative to each other; iii) an energy absorbing section which dampens axial bit displacements; iv) a rotation transfer section which allows any rotation and torque applied to the drill string above the tool to be applied to the bit; and v) an optional axial force generating section.

7 Claims, 9 Drawing Sheets

(51) Int. Cl.
*E21B 3/00* (2006.01)
*E21B 12/00* (2006.01)

(56) References Cited

U.S. PATENT DOCUMENTS

2014/0083772 A1 3/2014 Wiercigroch
2016/0123090 A1* 5/2016 Schultz ..... E21B 7/24
166/381

OTHER PUBLICATIONS

Canadian Patent Office, Office Action issued in corresponding Canadian Patent Application No. 2,950,826, dated Sep. 13, 2017 (4 pages).
Canadian Patent Office, Office Action issued in corresponding Canadian Patent Application No. 2,950,826, dated Jul. 3, 2018 (5 pages).

* cited by examiner

VIBRATION ASSISTED ROTARY DRILLING (VARD) TOOL

This application claims priority, under Section 371 and/or as a continuation under Section 120, to PCT Application No. PCT/CA2015/000345, filed on May 29, 2015, which claims priority to U.S. Provisional Application No. 62/005,533, filed on May 30, 2014.

FIELD OF THE INVENTION

The present invention relates to drilling tools. More particularly, the present invention relates to vibration assisted rotary drilling (VARD) tools.

BACKGROUND OF THE INVENTION

In conventional rotary drilling, a drill bit(s) is mounted on the end of a drill string, and a mixture of liquid and additives (drilling fluid or "mud") is pumped down the inside of the drill string and exits as fluid jets at the bit nozzles to cool and clean the bit, and flush the cuttings to the surface as the drill bit(s) grinds away at the rock formation. Drilling efficiency is generally governed by whether the rock cuttings are effectively removed by hydraulic forces of the drilling fluid jets.

Rotary drilling generally involves the application of axial force known as Weight-on-Bit ("WOB", the amount of downward force exerted on the drill bit), and rotary torque known as Torque-on-Bit ("TOB", the amount of rotational or turning force exerted on the drill bit), to push and rotate the drill bit to generate the cuttings. Unfortunately, it is well known that with increased depth, there is an increase in bottom hole pressure ("BHP") which holds the drill cuttings against the cutter face and the bottom of the hole, thereby impeding their efficient removal. This results in a reduction in the rate of penetration ("ROP") of the drill bit, and potentially increased well costs.

Currently, there are drilling tools which provide axial compliance in the drill string for the purpose of damping drill string vibration and shock in an attempt to overcome some vibration-related problems. These are typically called "shock subs" and are provided by several drilling technology companies. There are other drilling tools which provide axial force generation at the bit, but not in combination with axial compliance. There is no other drilling technology that specifically targets providing axial displacements at the drill bit through the use of axial compliance to allow the cuttings that are held down by the BHP to be displaced and removed more easily, and result in an increase in the drilling ROP. What is therefore needed is a novel, industrially viable, vibration assisted rotary drilling (VARD) tool that can increase ROP and drilling efficiency.

SUMMARY OF THE INVENTION

Disclosed are vibration assisted rotary drilling (VARD) tools which provide low amplitude axial displacements at the drill bit while applying WOB and transmitting the full rotary speed and torque of the drill string. These VARD Tools consist of: i) an axially compliant section which transfers axial load across the tool, ii) a mechanism for opposing ends of the tool to displace axially relative to each other, iii) an energy absorbing section which dampens axial bit displacements, iv) a rotation transfer section which allows the rotation and torque applied to a drill string above the tool to be applied to the drill bit, and v) an optional axial force generating section.

Under normal operating conditions, the VARD tool is installed in the Bottomhole Assembly ("BHA") directly behind the bit but can be installed further up in the BHA. Numerous manifestations of these 4 required and 1 optional components of the VARD tool can be achieved, using various types of materials and mechanical, hydraulic or pneumatic components. For example, most materials that comprise the body of the VARD tool would be alloys selected on the basis of strength and corrosion resistance, whereas energy absorbing/damping materials (used in item iii) would be selected from a variety of plastic, rubber or similar elastomers. Energy dampening can also be achieved by utilizing pressurized fluids in sealed chambers with interconnecting flow orifices. The axial force generating section (item v) can have various embodiments such as, but not limited to: a moving hydraulic valve assembly that periodically restricts the flow of drilling fluid acting on a pump open area ("POA") in the tool; a mechanically reciprocated or oscillated mass generating inertial reaction forces; an electro-magnetic mechanism which oscillates a magnetic mass or fluid; or a pulse cavitation mechanism which flows the drilling fluid through a venturi, generating cavitation bubbles which collapse and act on a POA in the tool. In the case of a VARD tool which does not include the optional axial force generating section (item v), the axially compliant section (item i) transforms just the natural axial forces generated by the cutting action of the drill bit cutters into axial displacement of the drill bit (this is hereinafter referred to as a passive VARD tool, with the ROP enhancement as shown in FIG. 1). In the case where a VARD tool includes the optional axial force generating section (item v), the axially compliant section (item i) transforms both the axial forces produced by the axial force generating section and the natural axial forces produced by the cutting action of the drill bit cutters into axial displacement of the drill bit (this is hereinafter referred to as an active VARD tool, with the ROP enhancement as shown in FIG. 2).

The tools of the present invention may be used to increase drilling ROP, increase drilling efficiency, or reduce the energy consumption per volume of penetrated rock.

BRIEF DESCRIPTION OF THE DRAWINGS

Various embodiments of the invention will now be described, by way of example, with reference to the accompanying drawings in which.

DETAILED DESCRIPTION OF THE INVENTION

The VARD tool of the present invention is capable of increasing drilling ROP, increasing drilling efficiency, and/or reducing the energy consumption per volume of penetrated rock. In particular, the VARD tool of the present invention is capable of overcoming the known problem of drilling ROP decreasing when the BHP increases with drilling depth. The present invention is therefore capable of increasing the ROP generally throughout the drilling operation, thus increasing drilling efficiency and reducing the time required to reach the drilling target, and thereby potentially reducing the overall costs associated with the drilling of a wellbore. This invention accordingly may have the added benefit of allowing drilling companies to drill more wells, including exploration wells, for similar drilling budgets.

Figure 1:
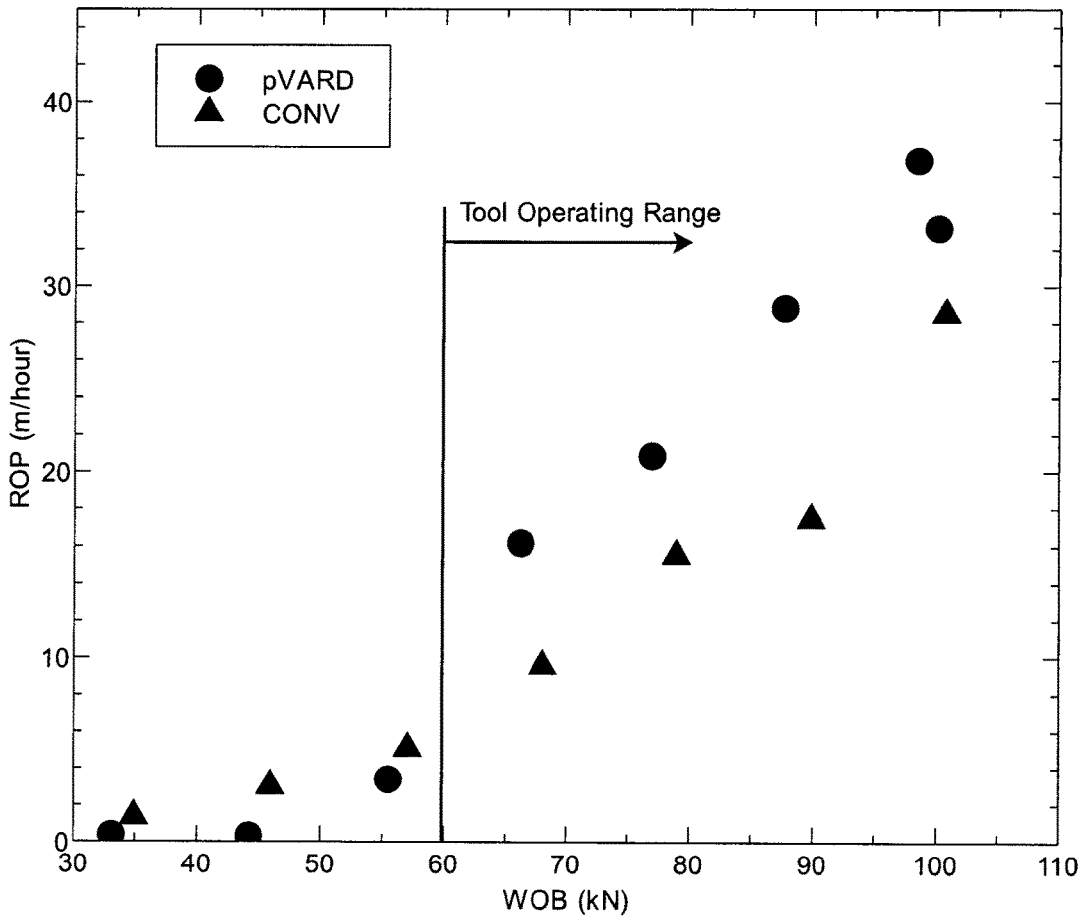
FIG. 1 is a chart showing ROP (m/hour) plotted against WOB (kN) comparing the results from field drilling experiments displaying the influence of a passive VARD tool wherein the data points for "pVARD" shows the higher ROP that was achieved at several WOB when a pVARD tool was included in the drilling BHA, and the data points for "CONV" showing the lower ROP that was achieved at similar WOB when no pVARD tool was employed.
Figure 2:
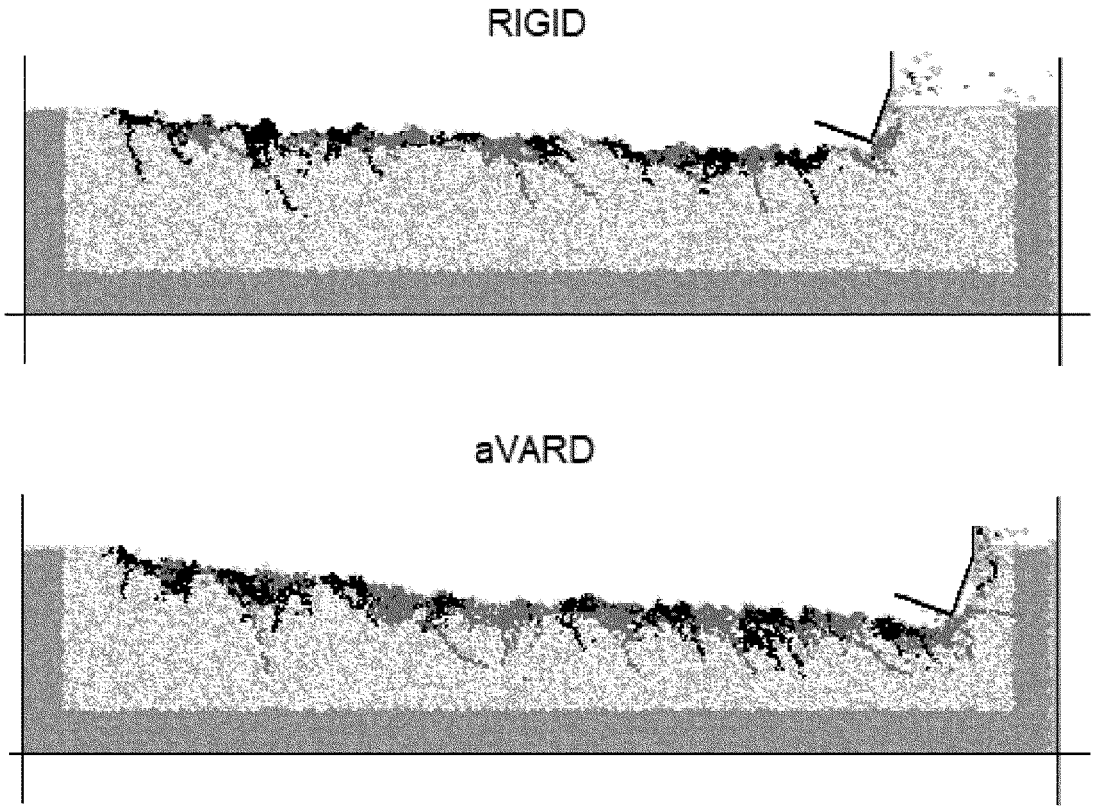
FIG. 2 is a computerized display showing the results from a distinct element method ("DEM") model simulation of drag bit cutter penetration in rock showing the influence of an active VARD tool. For the image labeled "aVARD" the vertical force oscillations and the compliance of the active VARD tool were applied to the drag bit cutter, and for the image labelled as "RIGID" no active VARD tool was simulated.

In particular, through scientific laboratory investigation and field tests with our novel tool, we have discovered that low magnitude axial displacement of the drill bit allows for the cuttings that are held down by the BHP to be displaced and removed more easily, resulting in an overall increase in ROP. Drilling results were evaluated on the basis of ROP, mechanical specific energy ("MSE"), bit loads and bit displacements. The tool was tested both with and without compliance to evaluate the effects of the compliant element. FIG. 1 shows our results from field drilling experiments displaying the influence of a passive VARD tool (i.e. one that does not contain an axial force generating section, described below). The data points denoted as "pVARD" show the higher ROP that was achieved when a passive VARD tool was used in the drilling system and the WOB was within the operational range of the tool, as compared to the data points for "CONV" when no passive VARD tool was employed. FIG. 2 shows our results from a distinct element method ("DEM") model simulation of drag bit cutter penetration in rock, displaying the influence of an active VARD tool (i.e. one containing an axial force generating section, described below). In particular, the upper part of the figure labelled "RIGID" shows the cutter penetration without using an active VARD tool, while the lower part of the figure labeled "aVARD" shows the higher penetration achieved when an active VARD tool is used; otherwise, all other drilling parameters were the same.

Figure 3:
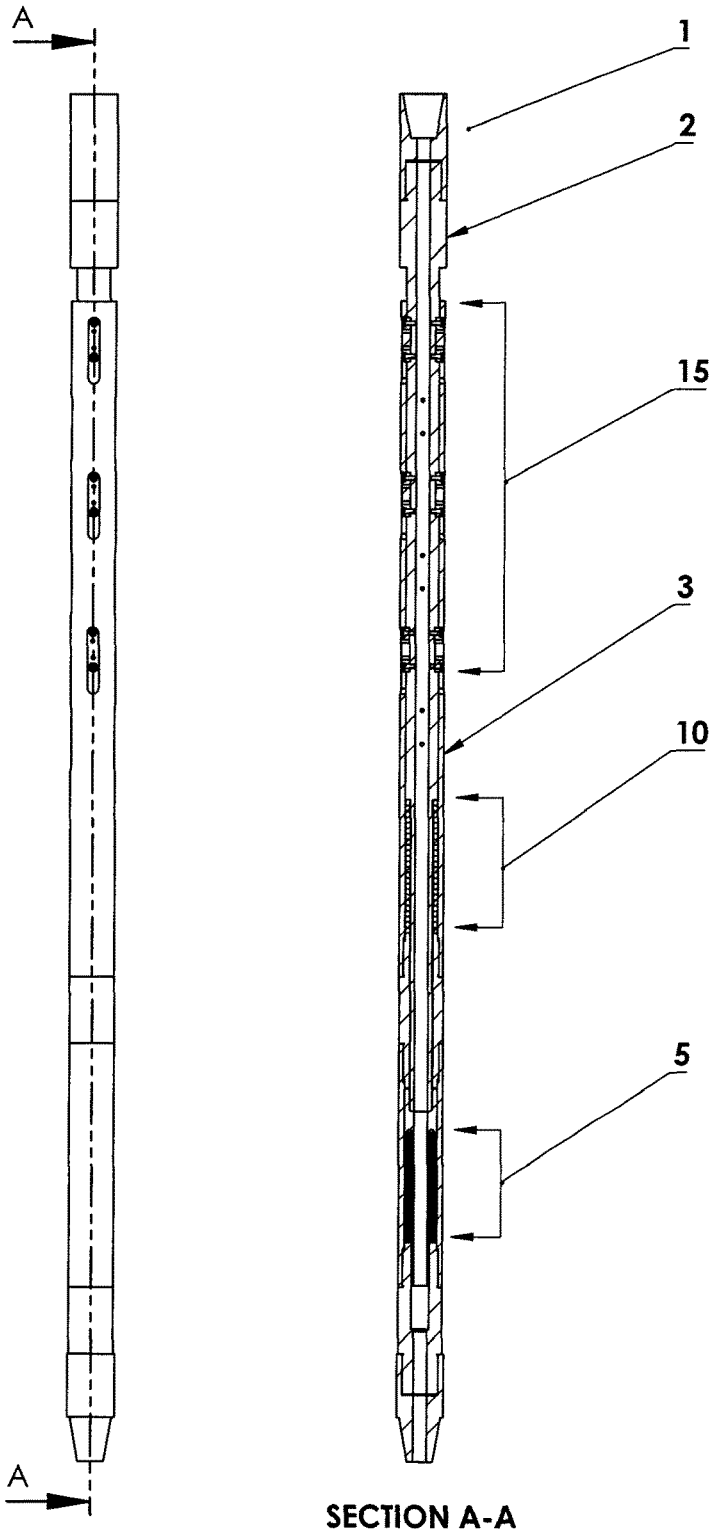
FIG. 3 is a schematic representation of a passive VARD tool in accordance with one embodiment of the present invention.
Figure 4A:
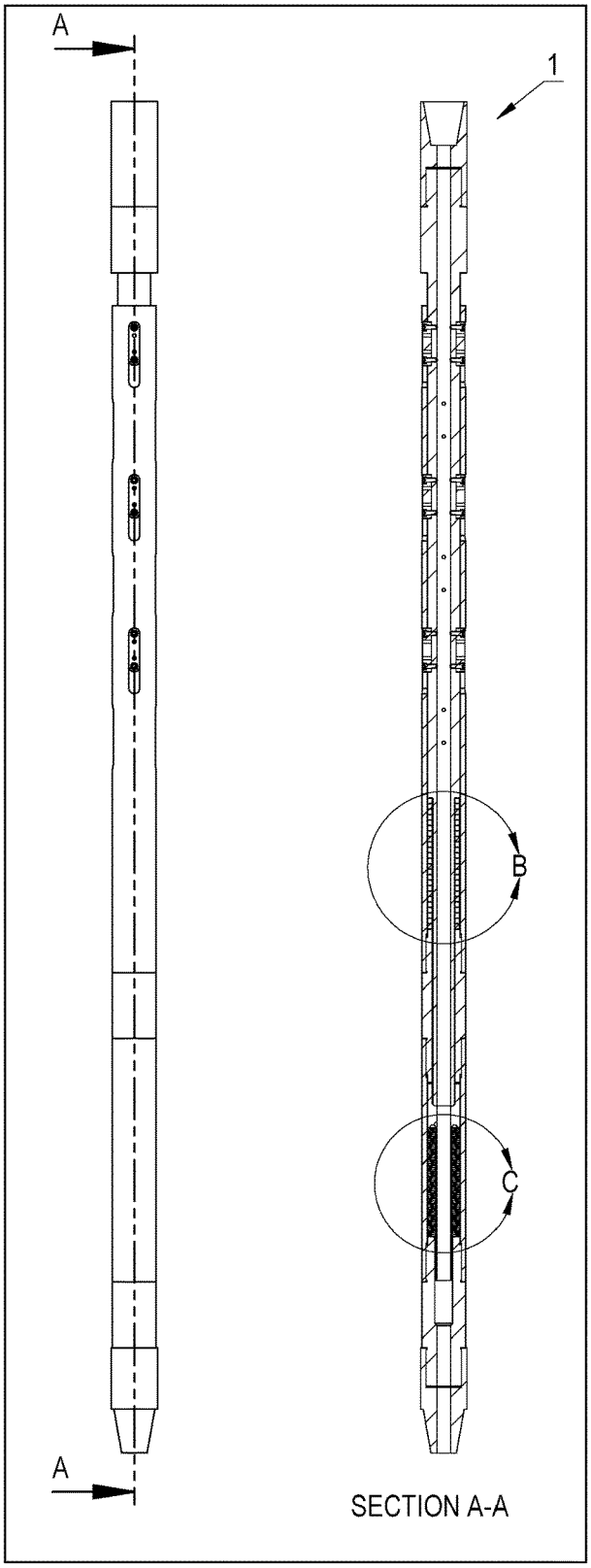
FIG. 4 is a schematic representation of the energy absorbing and axially compliant sections, respectively, of the passive VARD tool shown in FIG. 3 in accordance with one embodiment of the present invention.
Figure 4B:
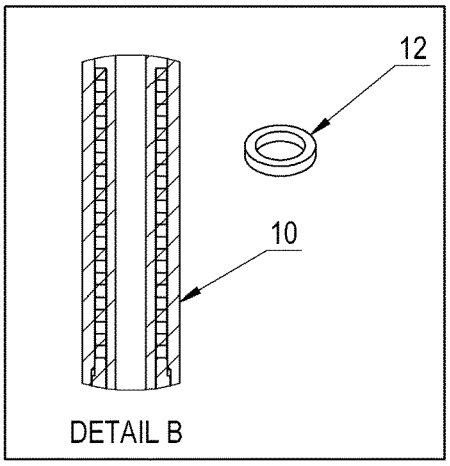
Figure 4C:
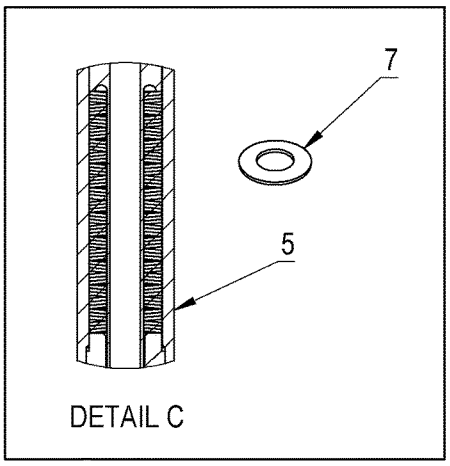
Figure 6:
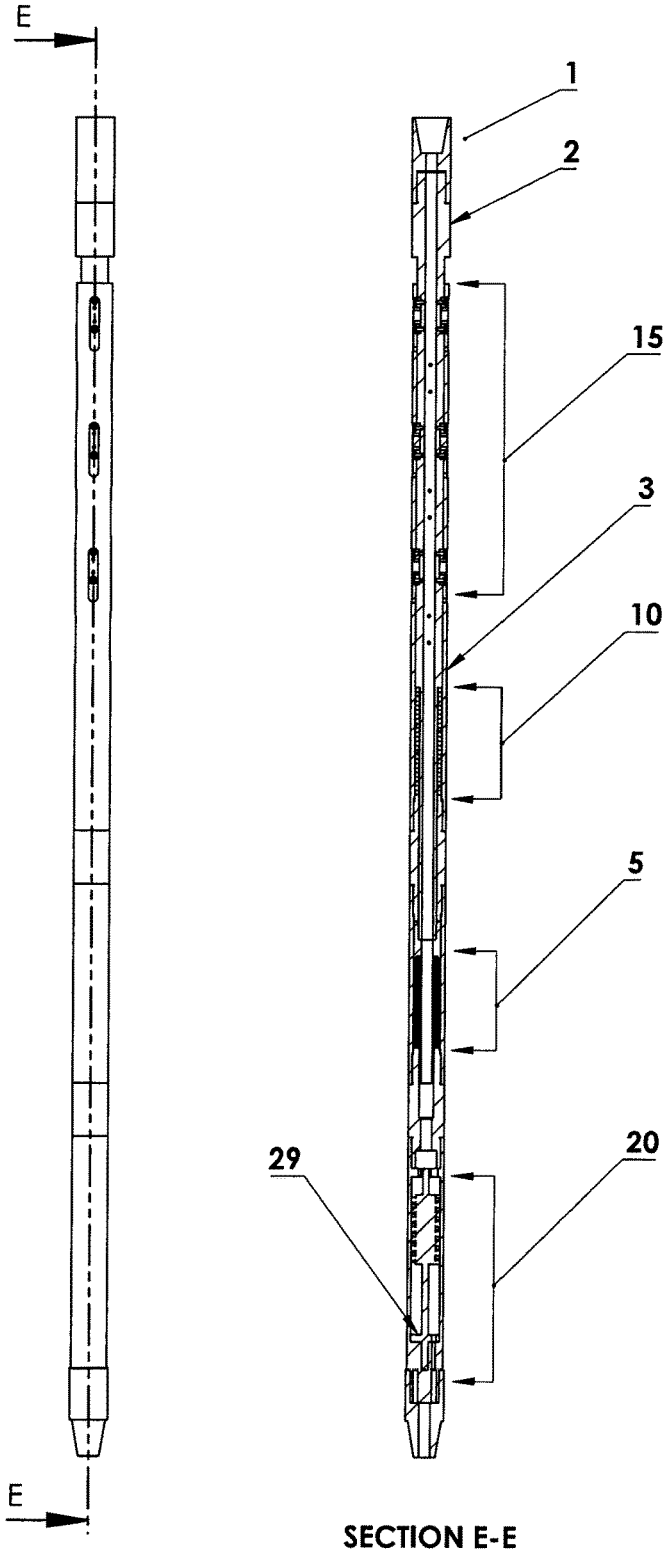
FIG. 6 is a schematic representation of an active VARD tool in accordance with a third embodiment of the present invention.
Figure 7A:
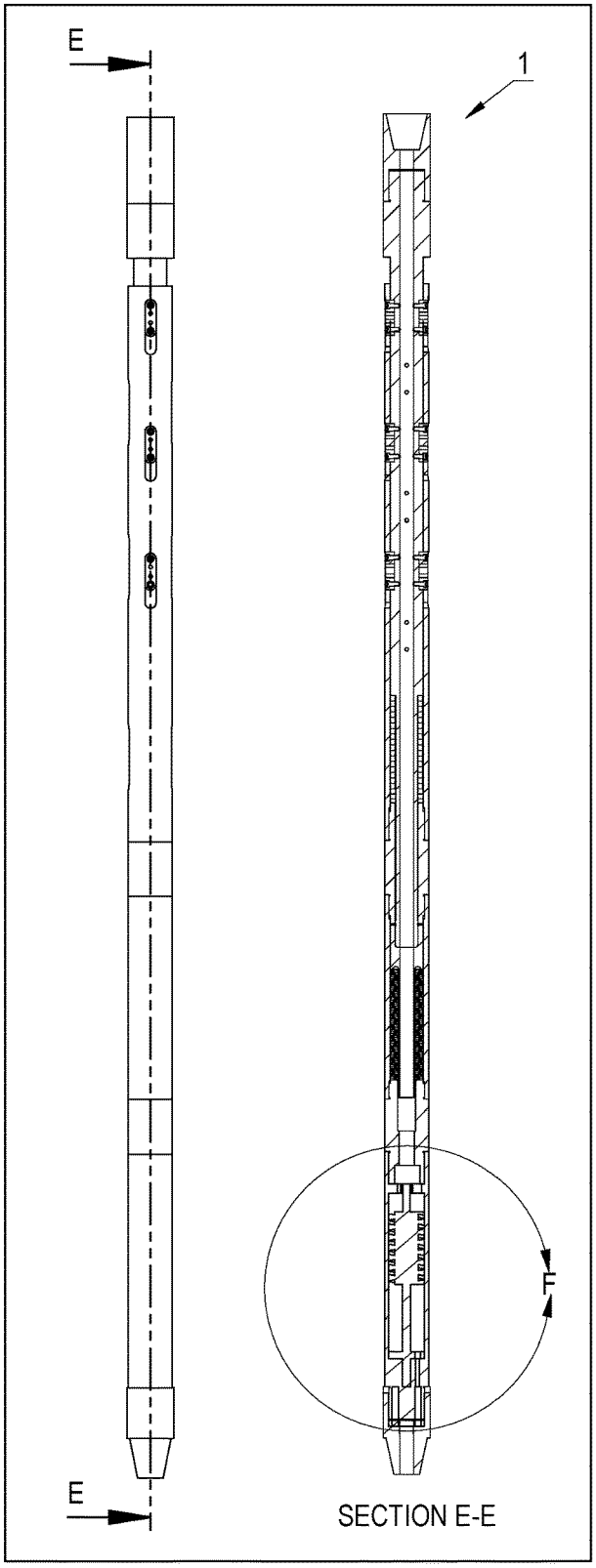
FIG. 7 is a schematic representation of the axial force generating section of an active VARD tool shown in FIG. 6 in accordance with a third embodiment of the present invention.
Figure 7B:
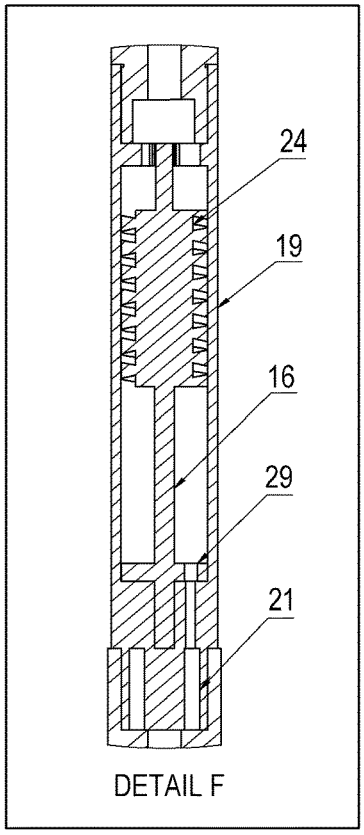
Figure 8:
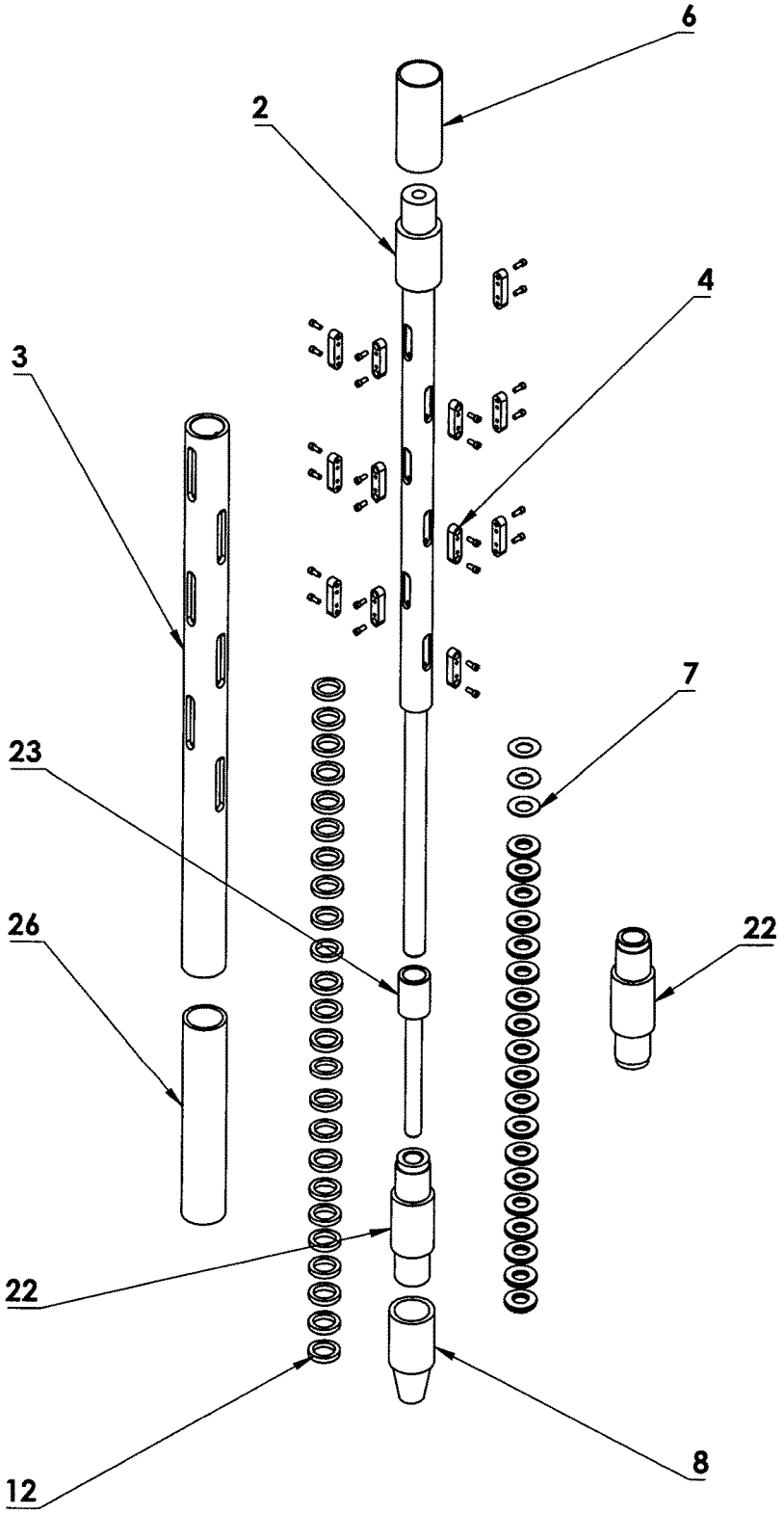
FIG. 8 is an exploded assembly drawing of a passive VARD tool shown in FIG. 3 in accordance with one embodiment of the present invention.

The VARD tool 1 would normally be housed in an outer shell 3, and consists of: i) an axially compliant section 5 which transfers axial load across the tool 1, ii) a mechanism for opposing ends of the tool to displace axially relative to each other, iii) an energy absorbing section 10 which dampens axial bit displacements, and iv) a rotation transfer section 15 which allows the rotation and torque applied to a drill string above the tool 1 to be applied to the bit (these 4 items alone providing a passive VARD tool as shown, for example, in FIG. 3), as well as v) an optional axial force generating section 20 (the addition of which provides an active VARD tool as shown, for example, in FIG. 6). The axially compliant section 5 may contain stacks of Belleville washers 7 (as shown in FIG. 4) or springs (or other similar material known to persons skilled in the art) or pressurized fluid that transfers the axial force from the top to the bottom of the tool 1 while allowing axial vibration to occur. The mechanism for opposing ends of the tool 1 to displace axially relative to each other may be achieved by use of an inner shaft 2 and an outer shell 3, as shown in FIG. 3. The energy absorbing section 10 contains dampening material that is capable of absorbing axial vibration energy, which may also be done through the use of hydraulic dampening. The rotation transfer section 15 allows the outer shell 3 of the tool 1 to move axially with respect to the inner shaft 2 of the tool 1, while transferring rotary power through the use of keyways 4 (as shown in FIG. 8) or a spline. The optional axial force generating section 20 is shown in FIG. 7 as comprising a valve assembly 29 mounted on the turbine shaft 16 that rotates with the turbine 24 and acts to vary the orifice of the valve assembly 29 to alternately reduce and increase the flow rate of drilling fluid flowing through the tool, resulting in pressure fluctuations that act on the POA 21 of the tool to generate axial force on a bit (although several other potential embodiments for axial force generating section 20 are described below).

Under normal operating conditions, the VARD tool is installed in the Bottomhole Assembly ("BHA") directly behind the drill bit but can be installed further up in the BHA. Numerous manifestations of these 4 required and 1 optional components of the VARD tool can be achieved, using various types of materials and mechanical, hydraulic or pneumatic components. For example, most materials that comprise the body of the VARD tool would be alloys selected on the basis of strength and corrosion resistance, whereas energy absorbing/damping materials (used in item iii, the energy absorbing section 10) would be selected from a variety of plastic, rubber or similar elastomers. Energy dampening can also be achieved by utilizing pressurized fluids in sealed chambers with interconnecting flow orifices, as would be known to persons skilled in the art. The axial force generating section 20 (item v) can have various embodiments that would be known to persons skilled in the art, such as, but not limited to: a moving hydraulic valve assembly that periodically restricts the flow of drilling fluid acting on a POA in the tool; a mechanically reciprocated or oscillated mass generating inertial reaction forces; an electro-magnetic mechanism which oscillates a magnetic mass or fluid; or a pulse cavitation mechanism which flows the drilling fluid through a venturi, generating cavitation bubbles which collapse and act on a POA in the tool. In the case of a VARD tool 1 which does not include the optional axial force generating section 20 (item v), the axially compliant section 5 (item i) transforms just the natural axial forces generated by the cutting action of the drill bit cutters into axial displacement of the drill bit (this is a passive VARD tool, with the ROP enhancement as shown in FIG. 1). In the case where a VARD tool 1 includes the optional axial force generating section 20 (item v), the axially compliant section 5 (item i) transforms both the axial forces produced by the axial force generating section 20 and the natural axial forces produced by the cutting action of the drill bit cutters into axial displacement of the drill bit (this is an active VARD tool, with the ROP enhancement as shown in FIG. 2).

Figure 5:
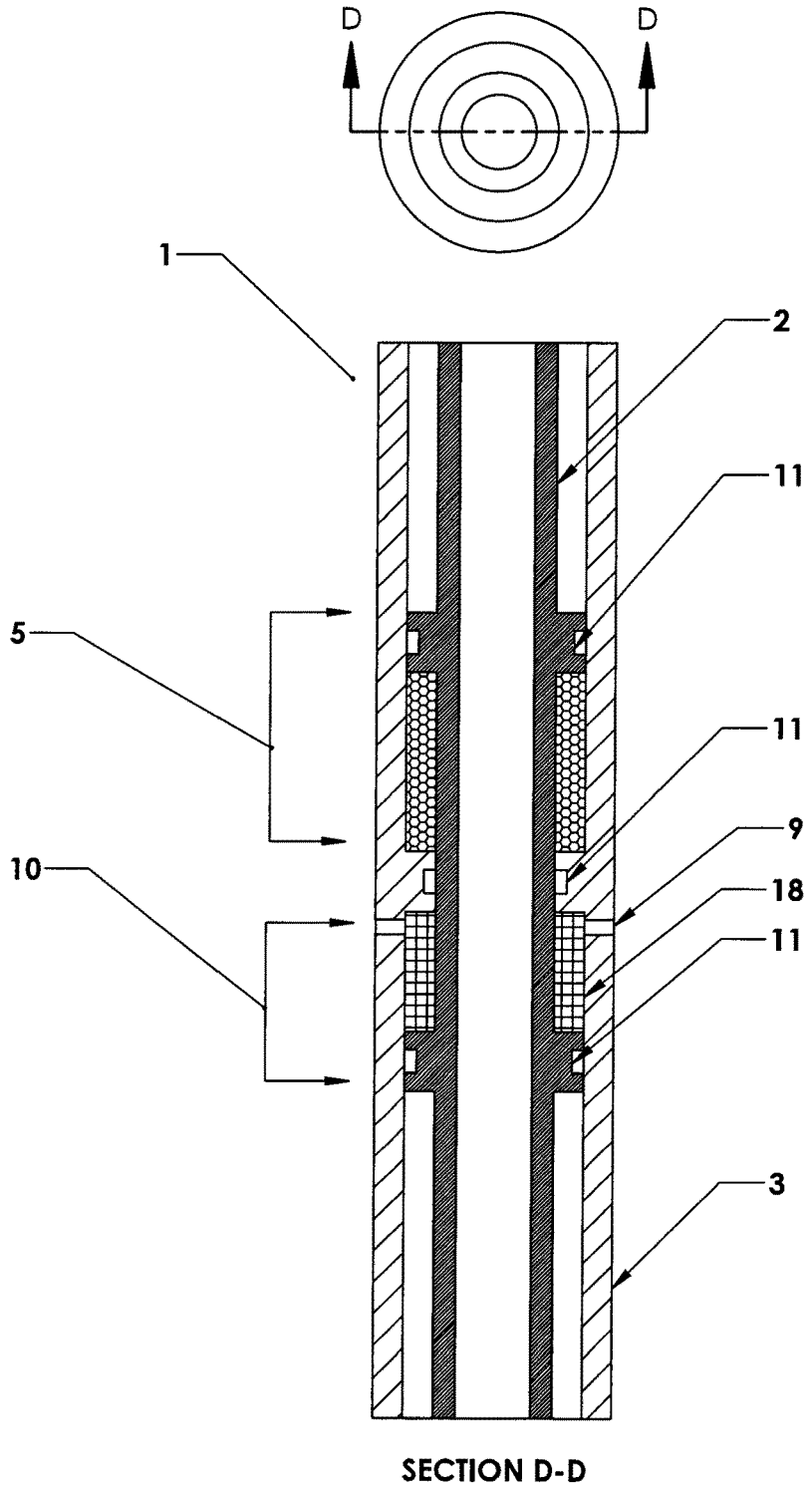
FIG. 5 is a schematic representation of the energy absorbing and axially compliant sections, respectively, of a passive VARD tool in accordance with a second embodiment of the present invention.

FIG. 3, as mentioned, displays a schematic representation of a passive VARD tool in accordance with one embodiment of the present invention. In this embodiment, the VARD tool 1 comprises a hollow inner shaft 2 and outer shell 3 that provides relative movement (axial displacement) between opposing ends of the tool (i.e. item 2, the mechanism for opposing ends of the tool to displace axially relative to each other). More specifically, inner shaft 2 transfers torque and load from the drill string to the outer shell 3, while outer shell 3 transfers torque and axial load back to the drill string. Also in this embodiment, the axially compliant section 5 comprises stacks of Belleville washers 7 or coil springs to provide axial compliance, an elastomer/dampening material is used in the energy absorbing section 10 to provide energy absorption dampening, and a keyways 4/spline section is used within the rotation transfer section 15 to provide rotation transfer. FIG. 4 provides a schematic representation of the energy absorbing section 10 and axially compliant section 5, respectively, of the passive VARD tool as shown in FIG. 3 in accordance with one embodiment of the present invention. The axially compliant section 5 is shown comprising stacks of Belleville washers 7 or coil springs to transfer axial load (for axial compliance), while the energy absorbing section 10 is shown employing stacked rings of energy absorbing material 12 for dampening vibration (which could also be done using hydraulic dampening). FIG. 5 provides a schematic representation of the energy absorbing section 10 and axially compliant section 5 of a passive VARD tool as shown in FIG. 3 in accordance with a second embodiment of the present invention. In this embodiment, the passive VARD tool uses hydraulic mechanisms for both axial compliance and energy dampening. Here, the axially compliant section 5 contains pressurized fluid that transfers the axial force from the top to the bottom of the tool 1 while allowing axial vibration to occur; the energy absorbing section 10 is shown as a sealed piston chamber 18 with orifices 9 to the drilling fluid contained within the outer shell 3. Fluid flow through these orifices 9 act as a dampener to absorb axial vibration energy. Shaft seals 11 prevent the pressurized fluid from travelling between the piston chamber 18 and the outer shell 3 except through the orifices 9 which restricts the fluid flow rate and the axial piston movement thus dampening the axial displacement. Once again, inner shaft 2 transfers torque and load from the drill string to the outer shell 3, while outer shell 3 transfers torque and axial load back to the drill string.

FIG. 6 displays a schematic representation of an active VARD tool in accordance with a third embodiment of the present invention. In this embodiment, the VARD tool 1 comprises a hollow inner shaft 2 and outer shell 3 that provides relative movement (axial displacement) between opposing ends of the tool (i.e. item 2, the mechanism for opposing ends of the tool to displace axially relative to each other). More specifically, inner shaft 2 transfers torque and load from the drill string to the outer shell 3, while outer shell 3 transfers torque and axial load back to the drill string. Also in this embodiment, the axially compliant section 5 comprises stacks of Belleville washers 7 or coil springs to provide axial compliance, an elastomer/dampening material is used in the energy absorbing section 10 to provide energy absorption dampening, a keyways/spline section is used within the rotation transfer section 15 to provide rotation transfer, and an axial force generating section 20 is used to apply axial force on a drill bit. FIG. 4 provides a schematic representation of the energy absorbing section 10 and axially compliant section 5, respectively, as they could also be in the active VARD tool as shown in FIG. 6 in accordance with the third embodiment of the present invention. The axially compliant section 5 is shown comprising stacks of Belleville washers 7 or coil springs to transfer axial load (for axial compliance), while the energy absorbing section 10 is shown employing stacked rings of energy absorbing material 12 for dampening vibration (which could also be done using hydraulic dampening). FIG. 7 provides a schematic representation of the axial force generating section 20 as comprising a valve assembly 29 mounted on turbine shaft 16 that acts to vary the opening of the orifice of the valve assembly 29 when it is rotated by turbine 24 to alternately reduce and increase the flow rate of drilling fluid flowing through the tool, resulting in pressure fluctuations that act on the tool POA 21 to generate axial force on a bit (although several other potential embodiments for axial force generating section 20 are available as described previously). The axial compliant section 5 permits the axial forces acting on the bit to result in axial bit displacements, and the frequency and amplitude of these axial displacements can be adjusted by changing the configuration of the valve assembly 29, the axially compliant section 5 and/or the energy absorbing section 10, as would be known by a person skilled in the art.

Figure 9:
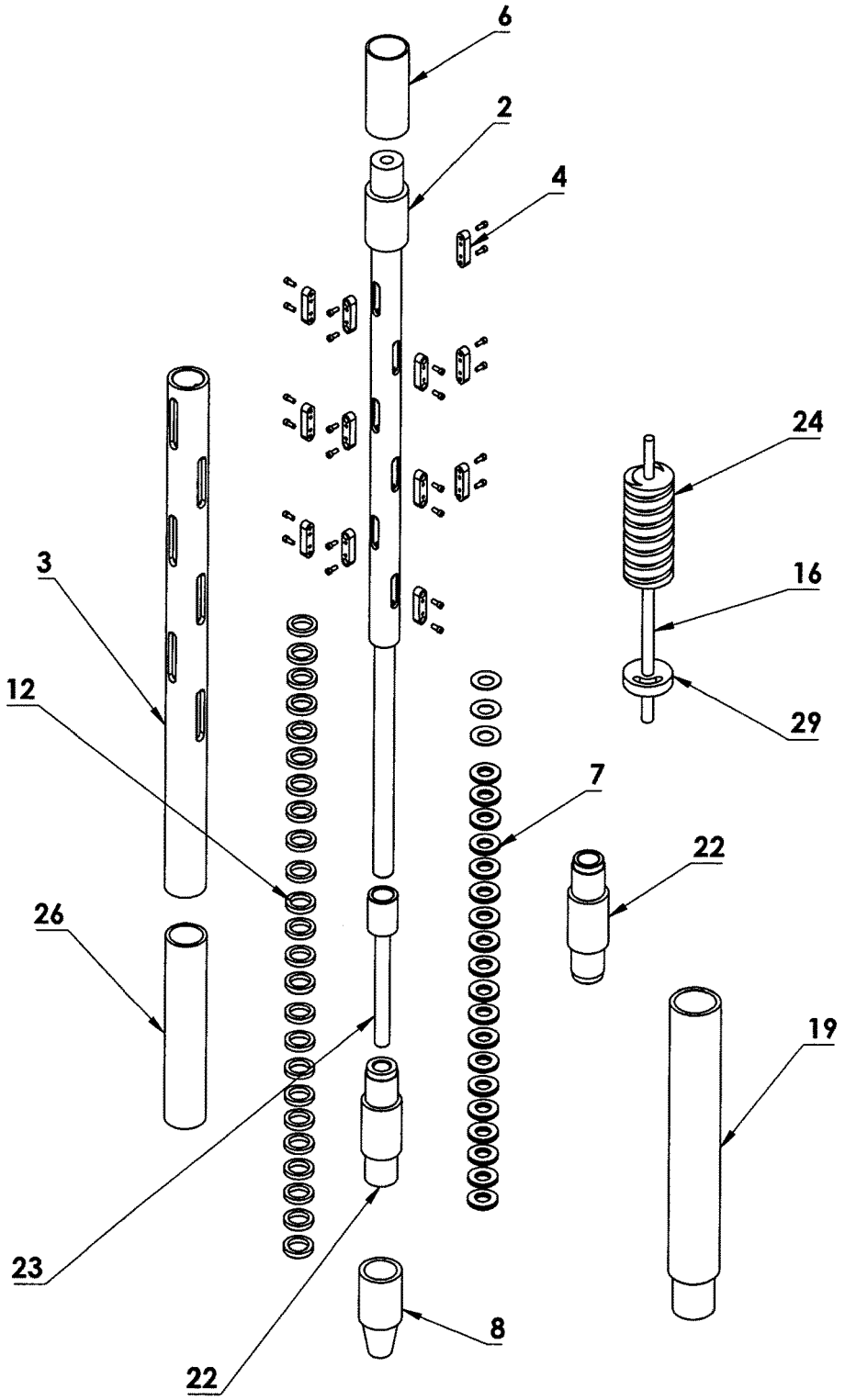
FIG. 9 is an exploded assembly drawing of an active VARD tool shown in FIG. 6 in accordance with a third embodiment of the present invention.

FIG. 8 and FIG. 9 present exploded assembly drawings of the passive VARD tool shown in FIG. 3 and the active VARD tool shown in FIG. 6, respectively, to provide persons skilled in the art with easy understanding of the mechanisms and assembly of these tools. FIG. 8 for the passive VARD tool shows API box connection 6 and the API pin connection 8 to mount the tool in the BHA, the outer shell 3 and the hollow inner shaft 2 with keyways 4 to allow relative displacement between both ends of the tool and to transfer rotation, the Belleville washers 7 which are stacked on the spring stack mandrill 23 and the spring stack shell 26 which together comprise the axially compliant section 5, the rings of energy absorbing material 12 that are stacked on the lower portion of the inner shaft 2 to provide axial dampening, and the threaded couplings 22 which connect the spring stack shell 26 to the outer shell 3 and the API pin connection 8. FIG. 9 for the active VARD tool shows all the elements shown in FIG. 8 plus the components of the axial force generating section 20, which is comprised of the axial force generator shell 19, the turbine 24, the turbine shaft 16 and the rotating valve assembly 29.

We claim:

1. A vibration assisted rotary drilling (VARD) tool comprising:

i) an axially compliant section which transfers axial load across the tool;

ii) a mechanism for opposing ends of the tool to displace axially relative to each other;

iii) an energy absorbing section which is axially displaced from the axially compliant section and dampens axial bit displacements, and iv) a rotation transfer section which allows any rotation and torque applied to a drill string above the tool to be applied to a drill bit, wherein said VARD tool is capable of providing low amplitude axial displacements at the drill bit while applying weight-on-bit and the drill string operates at full rotary speed and torque.

2. A vibration assisted rotary drilling (VARD) tool as claimed in claim 1 wherein the tool further comprises an axial force generating section.

3. The VARD tool as claimed in claim 2 wherein the axially compliant section transforms axial forces produced by the axial force generating section and natural axial forces produced by a cutting action of cutters of the drill bit into axial displacements of the drill bit.

4. The VARD tool as claimed in claim 2 wherein the axial force generating section comprises a moving hydraulic valve assembly that periodically restricts flow of drilling fluid acting on a pump open area in the tool.

5. The VARD tool as claimed in claim 1 wherein the VARD tool is installed in a bottomhole assembly (BHA) directly behind the drill bit.

6. The VARD tool as claimed in claim 1 wherein the VARD tool is installed in a bottomhole assembly (BHA) remote from the drill bit.

7. The VARD tool as claimed in claim 1 wherein the axially compliant section transforms natural axial forces produced by a cutting action of cutters of the drill bit into axial displacements of the drill bit.

* * * * *